US005138767A

United States Patent [19]

Locke

[11] Patent Number: 5,138,767

[45] Date of Patent: Aug. 18, 1992

[54] ENHANCED CUTTING SYSTEM FOR ELECTRIC DRY SHAVERS

[75] Inventor: David R. Locke, Bridgeport, Conn.

[73] Assignee: Remington Products, Inc., Bridgeport, Conn.

[21] Appl. No.: 667,348

[22] Filed: Mar. 11, 1991

[51] Int. Cl.[5] ..... B26B 19/02

[52] U.S. Cl. ..... 30/43.92; 30/41; 30/43.9

[58] Field of Search ..... 30/43.92, 44, 43.9, 30/41.6, 41

[56] References Cited

U.S. PATENT DOCUMENTS

| | | | |
|---|---|---|---|
| 2,458,417 | 1/1949 | Pollifrone | 30/41.6 |
| 3,947,961 | 4/1976 | Meyer | 30/41 |
| 3,967,372 | 7/1976 | Beck et al. | 30/43.92 |
| 4,031,617 | 6/1977 | Tanaka et al. | 30/43.92 |
| 4,219,930 | 9/1980 | Franko et al. | 30/43.92 |
| 4,381,603 | 5/1983 | Schreiber et al. | 30/43.92 |
| 4,796,359 | 1/1989 | Oprach et al. | 30/43.92 |
| 4,825,542 | 5/1989 | Locke | 30/43.92 |
| 4,884,338 | 12/1989 | Stewart | 30/43.92 |

FOREIGN PATENT DOCUMENTS

| | | | |
|---|---|---|---|
| 0291889 | 11/1989 | Japan | 30/41 |

*Primary Examiner*—Frank T. Yost
*Assistant Examiner*—Hwei-Siu Payer
*Attorney, Agent, or Firm*—Melvin I. Stoltz

[57] ABSTRACT

By providing biasing member in direct controlled biasing engagement with the mesh screen or apertured foil of an electric dry shaver and its cutting blades, a substantially improved and enhanced cutting system is achieved. In this invention, the biasing member continuously provide biasing forces on the mesh screen or apertured foil to maintain the screen or foil in constant contact with the cutting blades of the shaver. As a result, separation of the foil from the blades is virtually eliminated and a substantially enhanced comfort and cutting efficacy is attained.

4 Claims, 4 Drawing Sheets

FIG. 2
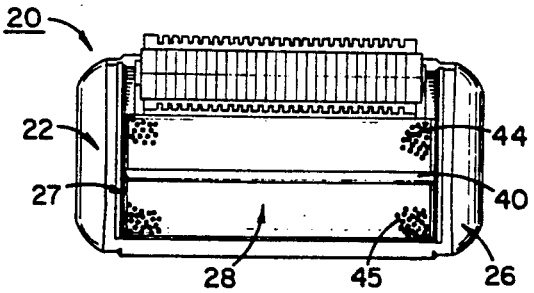
FIG. 3
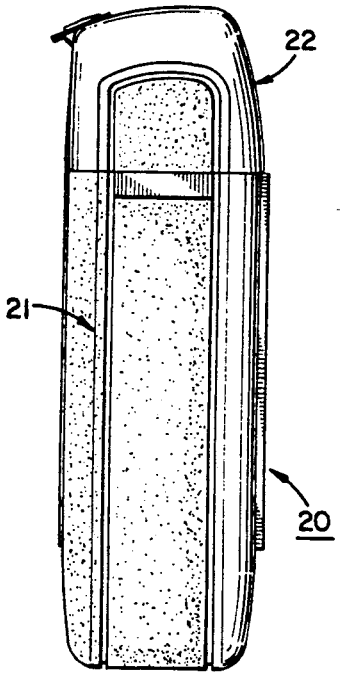
FIG. 1
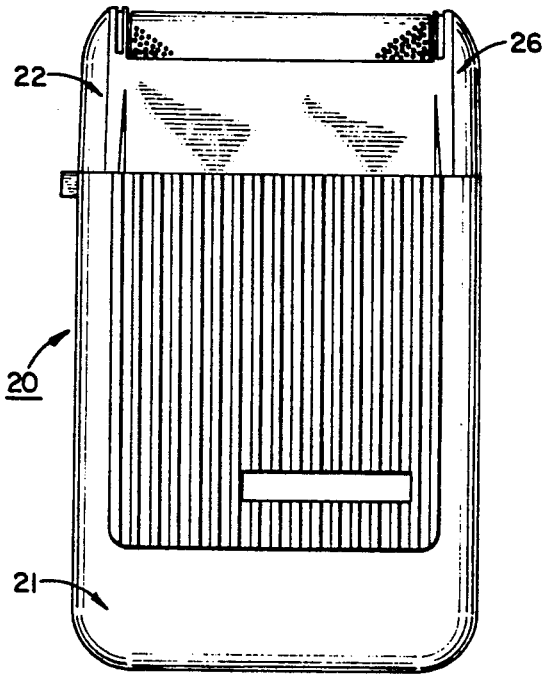
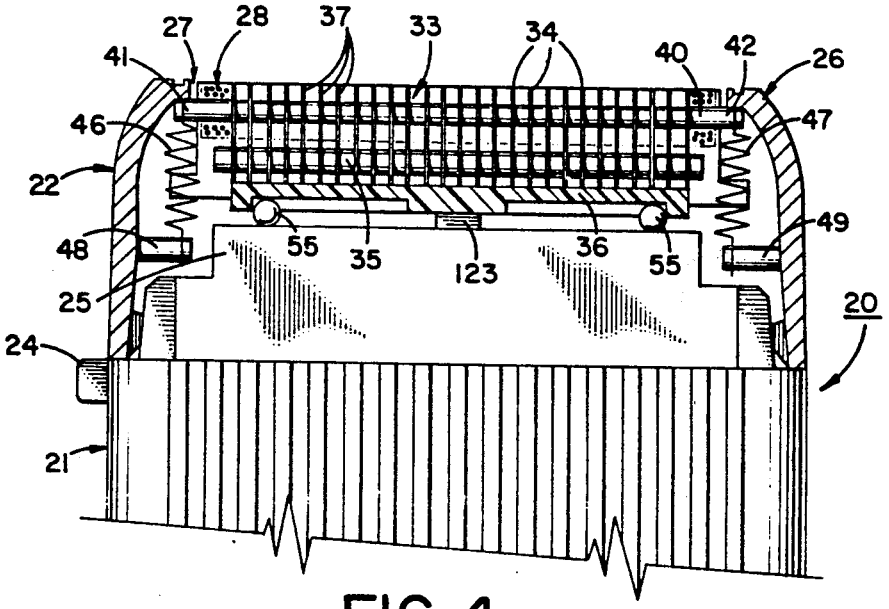
FIG. 4

FIG. 8
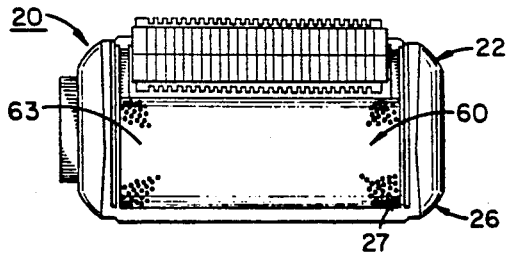
FIG. 9
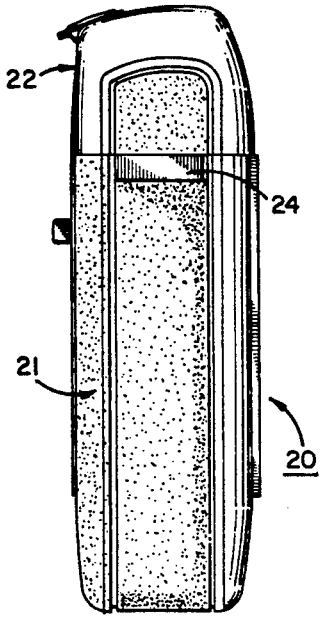
FIG. 7
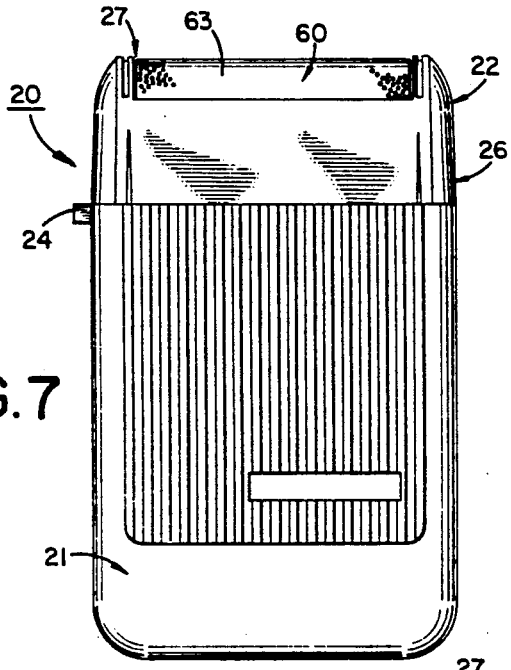
FIG. 11
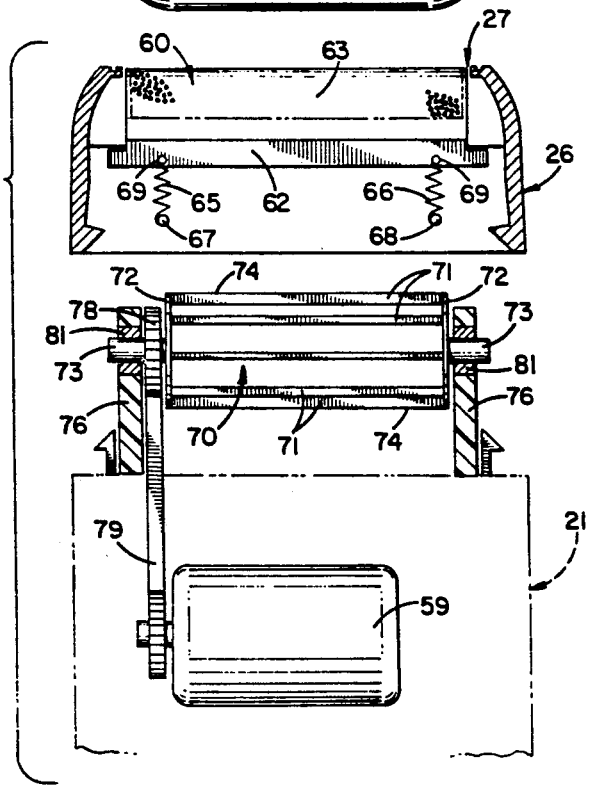
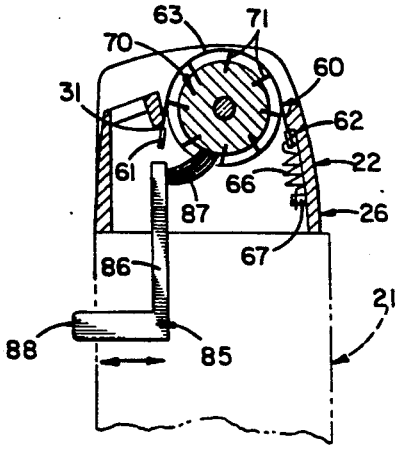
FIG. 10

ENHANCED CUTTING SYSTEM FOR ELECTRIC DRY SHAVERS

TECHNICAL FIELD

This invention relates to electric dry shavers and more particularly to an enhanced cutting system for substantially improving the comfort and cutting efficiency of electric dry shavers.

BACKGROUND ART

Over the last several years, both men and women have been increasingly drawn to the advantages provided by electric dry shavers. In general, the consuming public has found that the use of razors or other systems is extremely inconvenient for removing or shaving short hair or stubble, as commonly found in mens' beards and womens' legs. In addition, with the ever increasing time constraints and commitments individuals typically encounter, a fast and effective shaving system is most desirable.

The discomfort as well as the time consumed in using shaving cream, soaps and gels in order to provide a medium for which a razor can be used, requires more time and inconvenience than most individuals are willing or capable of allowing. Furthermore, the cost of maintaining a sufficient supply of these products creates an additional burden. Consequently, electric dry shavers have become increasingly popular, as well as battery operated electric dry shavers which can withstand exposure to moisture, thereby enabling individuals to simultaneously shower as well as shave either beards or legs.

As the popularity of electric dry shavers increased, various product designs and alternate constructions proliferated, in an attempt to improve and enhance the comfort and cutting efficiency of such shavers. However, in spite of these product changes, difficulties have continued to exist in providing optimum results with optimum comfort.

One particular configuration has been found to be extremely efficacious in achieving high quality shaving results, as well as being extremely comfortable to use. This configuration comprises the various models of electric dry shavers incorporating a movable cutting blade which cooperates with a thin, flexible mesh screen, or apertured foil.

In operation, the cutting blades are rapidly and continuously moved against one side of the mesh screen or apertured foil, causing the cutting blades to repeatedly cross the plurality of apertures and provide a virtually continuous cutting action at each aperture. Then, by sliding or guiding the other side of the mesh screen or apertured foil over the skin surface to be shaved, the individual hair shafts enter the holes formed in the screen or foil and are cut by the movement of the cutting blades.

Although this dry shaving cutting system has proven to be extremely effective, as compared to other dry shaving products, one area of difficulty does exist. In certain instances, as the mesh screen or apertured foil is moved over the skin surface in order to attain the desired cutting action, the contours of the skin act upon the apertured foil and cause the foil to deflect in various directions. Since the cutting blades are in intimate contact with the opposed side of the apertured foil, the deflection of the foil also causes the cutting blades to be simultaneously deflected therewith.

Unfortunately, at certain times, the apertured foil and the cutting blades do not simultaneously move in completely identical directions and, as a result, the cutting blade is moved out of intimate, contacting, cutting engagement with at least a portion of the surface of the apertured foil. When any such separation occurs, the movement of the cutting blade is incapable of attaining the requisite cutting action against the surface of the apertured foil, causing discomfort to the user.

In an attempt to eliminate this difficulty, most prior art electric dry shavers have mounted the cutting blade assembly in combination with spring means in order to continuously urge the cutting blade assembly into contact with the surface of the apertured foil. Conceptually, this construction was to continuously retain the cutting blade in contact with the apertured foil, regardless of the deflection of the apertured foil and cutting blade assembly during use.

Unfortunately this prior art construction has been found to be incapable of eliminating the problem. Typically, the cutting blade assembly is constructed as an integral unit and continues to move as a unit. Consequently, under certain circumstances, portions of the surface of the apertured foil become separated from the cutting blades during use. This causes unshaven areas to continue to exist.

Consequently, it is a principal object of the present invention to provide an enhanced cutting system for electric dry shavers whereby unwanted disassociation of the cutting blade from the mesh screen or apertured foil is prevented.

Another object of the present invention is to provide an enhanced cutting system for electric dry shavers having the characteristic features described above which is capable of providing substantially improved comfort and shaving efficiency, while also providing enhanced and improved results.

Another object of the present invention is to provide an enhanced cutting system for electric dry shavers having the characteristic features described above which is capable of virtually eliminating areas where the shaver is incapable of cutting the desired hair due to the contours of the surface being shaved.

A further object of the present invention is to provide an enhanced cutting system for electric dry shavers having the characteristic features described above which virtually eliminates unwanted unshaven areas.

Other and more specific objects will in part be obvious and will in part appear hereinafter.

SUMMARY OF THE INVENTION

In the present invention, the difficulties and drawbacks encountered in prior art systems have been eliminated by mounting biasing means directly to the mesh screen or apertured foil, with the biasing means continuously acting on the mesh screen or apertured foil to maintain the screen or foil in constant contact with the cutting blades of the shaver. In this way, separation of the mesh screen or foil from the cutting blades is virtually eliminated and the problems encountered in prior art systems are completely eliminated.

Regardless of the type of cutting blade employed, the present invention provides for enhanced performance and increased cutting efficacy. By mounting biasing means directly to the mesh screen or apertured foil, constant, uniform, biasing forces are provided, continuously drawing the mesh screen or apertured foil into intimate, secure, frictional engagement with the cutting blades.

Although any type of cutting blade may be employed in carrying out the present invention, the two principal types of cutting blades comprise reciprocating cutters or reel type cutters. In reciprocating cutters, a plurality of cutting blade members are fixedly mounted in juxtaposed, spaced, parallel relationship to each other, forming a single elongated blade assembly. The blade assembly is repeatedly and rapidly driven by the motor in a side-to-side reciprocating motion. The mesh screen or apertured foil is positioned in overlying interengagement with the array of cutting edges of the cutting blades, thereby enabling the hairs passing through the holes of the screen or foil to be cut by the cutting edges of the blades as they move past the apertures.

In one typical construction frequently found in shavers, the cutting edges of the blade members are substantially "M"-shaped, in order to increase the cutting surface. In employing the present invention with this embodiment, the preferred construction incorporates an elongated foil contacting rod which longitudinally extends the entire length of the mesh screen or foil on the side opposite the cutting blade assembly. In addition, the rod is positioned substantially midway along the width of the blade assembly. In this way, the contacting rod extends along the length of the blade assembly, substantially between the two curved portions forming the "M" shape thereof.

In addition to extending completely through the middle of the contacting engagement zone between the mesh screen or foil and the blade members, both terminating ends of the contacting rod are secured to biasing means, which are anchored below the blade assembly. Furthermore, the biasing forces act on the elongated rod to draw the contacting rod towards the blade assembly. As a result, the mesh screen or apertured foil is maintained in continuous, intimate, contacting, frictional engagement with the surface of the blade assembly.

It has been found that regardless of the movement of the shaver over the skin surface being shaven and regardless of the contours of the skin surface, dislocation or disassociation of the mesh screen or foil from the blade assembly is eliminated. This is achieved by the spring biased contacting rod continuously maintaining the mesh screen or apertured foil in contact with the blade assembly, providing the desired intimate contacting interengagement therewith throughout the shaving procedure.

In typical alternate embodiments, the blade assembly does not possess "M" shaped blade members.

Instead, single, arcuately curved blade members are employed in a substantially similar assembly. Alternatively, a reel-type cutter assembly may be employed. However, regardless of the blade configuration, it has been found that by providing the same continuous, biased, intimate, contacting interengagement of the mesh screen or foil with the cutting blades, the prior art drawbacks are eliminated.

Preferably, the desired intimate contact is achieved with these alternate blade constructions by mounting the biasing means in direct, force-engaging contact with one end of the mesh screen or apertured foil, while the opposed end is anchored in the conventional manner. The remainder of the mesh screen or foil is placed in overlying frictional contacting engagement with the blade assembly.

With this arrangement, the mesh screen or apertured foil is continuously maintained in contacting, frictional, intimate engagement with the blade assembly due to the forces of the biasing means continuously drawing the screen or foil downwardly against the blade assembly. As a result, disassociation of the screen or foil from the blade member during use is completely eliminated and the prior art drawbacks are avoided.

The invention accordingly comprises the features of construction, combination of elements and arrangement of parts which will be exemplified in the constructions hereinafter set forth and the scope of the invention will be indicated in the claims.

THE DRAWINGS

For a fuller understanding of the nature and objects of the invention, reference should be had to the following detailed description, taken in connection with the accompanying drawings, in which:

FIG. 1 is a front elevation view, partially broken away, of an electric dry shaver incorporating a reciprocating blade assembly and one embodiment of the enhanced cutting system of the present invention;

FIG. 2 is a top plan view of the electric dry shaver of FIG. 1;

FIG. 3 is a side elevational view of an electric dry shaver of FIG. 1;

FIG. 4 is a greatly enlarged front elevation view, partially in cross-section, and partially broken away;

FIG. 7 is a front elevation view, partially broken away, of an electric dry shaver which incorporates a reel-type cutting blade in combination with an alternate embodiment of the enhanced cutting system of the present invention;

FIG. 8 is a top plan view of the electric dry shaver of FIG. 7;

FIG. 9 is a side elevational view of the electric dry shaver of FIG. 7;

FIG. 10 is a substantially enlarged side elevation view, partially in cross-section and partially broken away;

FIG. 11 is a greatly enlarged front elevation view, partially in cross-section and partially broken away;

DETAILED DESCRIPTION

Figure 5:
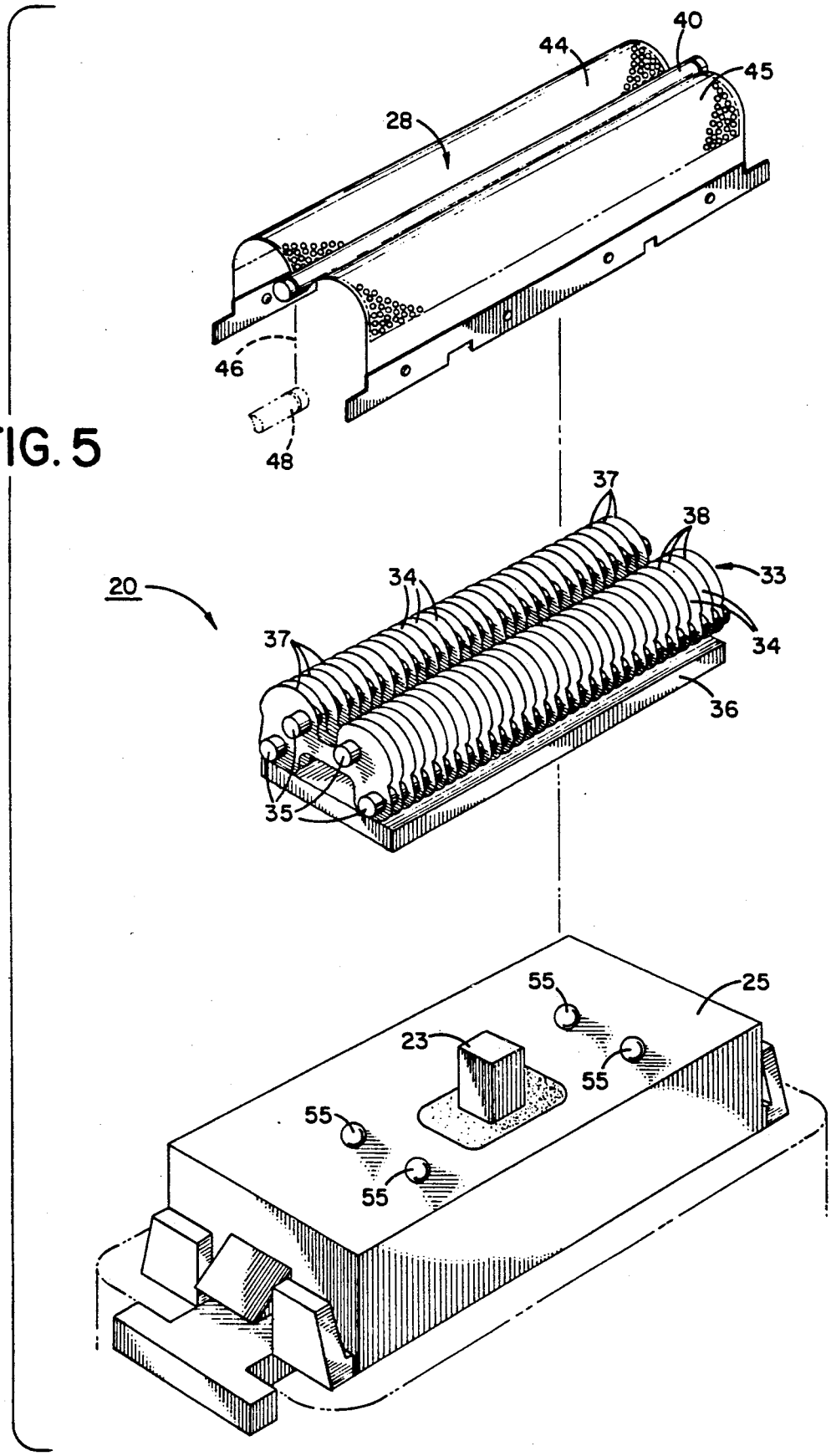
FIG. 5 is an exploded perspective view, partially broken away, detailing the enhanced cutting system of this invention with the electric dry shaver of FIG. 1.

In order to provide a complete detailed disclosure of the improved cutting system of this invention, the present invention is depicted in use with a particular reciprocating blade assembly and a particular reel-type blade assembly. However, the present invention is equally applicable to all similar blade constructions, and no limitation is intended by the following disclosure.

Furthermore, the electric dry shavers depicted in the following Figures are constructed for shaving beards. However, it is apparent to one of ordinary skill in this art that the improved cutting system defined herein is equally applicable to any electric dry shaver, whether such shaver is employed for males or females. Consequently, the scope of the protection afforded by the improved cutting system of this invention is not limited to the specific type of shavers depicted, and is equally applicable to any electric dry shaver construction.

In FIGS. 1–6, the improved cutting system of the present invention is shown in use with electric dry shaver 20 incorporating a reciprocating blade assembly 33. Electric dry shaver 20 comprises a housing 21 having raised platform 25, positioned for cooperating with the blade assembly 33. In addition, shaver 20 comprises a guard/cover assembly 22, which is removably secured to housing 21.

Housing 21 incorporates a motor (not shown) which drives a movement control pin 23 to reciprocally move in a rapid, side-to-side motion. As detailed below, blade assembly 33 is mounted to movement control pin 23, which extends through platform 25. Once assembled, pin 23 causes blade assembly 33 to continuously move in the desired, side-to-side, reciprocating manner.

As depicted throughout these drawings, guard/cover assembly 22 incorporates a base 26 which is constructed for telescopic, overlying, locking interengagement with platform 25 of housing 21. Release button 24 mounted to housing 21 cooperatingly engages base 26, enabling base 26 to be removed from housing 21, thereby obtaining access to blade assembly 33 and allowing cleaning of platform 25 and the surrounding area, when necessary.

Base 26 incorporates an open zone 27 formed in the top portion thereof. Zone 27 is dimensioned for receiving flexible mesh screen or apertured foil 28 in its secured, arcuately displayed configuration, thereby establishing the skin contact area for shaver 20.

As is well known in the art, mesh screen or apertured foil 28 comprises an elongated, extremely thin sheet material, preferably having a metallic composition, and incorporates a plurality of holes formed therein. As the outer surface of mesh screen or apertured foil 28 is rubbed across the skin surface to be shaven, the tiny hairs extending from the skin surface enter the apertured holes and are severed by the movement of the blades across the opposed surface thereof.

Figure 6:
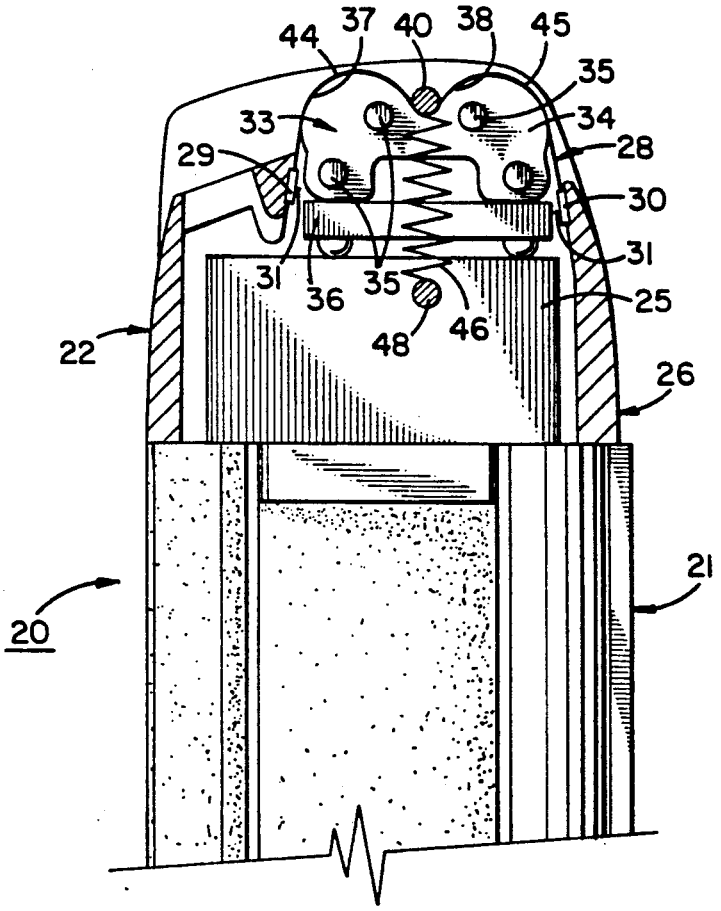
FIG. 6 is a substantially enlarged side elevation view, partially in cross-section, and partially broken away.

In this embodiment, mesh screen or apertured foil 28 comprises terminating ends 29 and 30, both of which are removably affixed along their length to base 26. As shown in FIG. 6, clip means 31 are mounted along an inside surface of base 26 for receiving and lockingly engaging mating recesses formed in terminating ends 29 and 30 of mesh screen or apertured foil 28. By employing clip means 31, screen or foil 28 is easily removable from base 26, thereby enabling screen or foil 28 to be changed whenever required.

As also clearly depicted in the drawings, apertured foil 28 is constructed to comprise two arcuately curved surfaces 44 and 45. Preferably, this dual surface construction is achieved by forming the single elongated mesh screen or apertured foil 28 in a substantially "M" shape in its retained position in base 26. In this way, maximum surface area is attained and, as detailed below, the general shape and contour of blade assembly 33 is matched. Furthermore, with both opposed ends 29 and 30 of mesh screen or apertured foil 28 securely mounted to base 26, arcuately curved surfaces 44 and 45 of screen or foil 28 are freely flexible. As a result, the desired cooperative, cutting engagement of mesh screen or apertured foil 28 with blade assembly 33 is assured.

As best seen in FIGS. 4, 5, and 6, blade assembly 33 comprises a plurality of independent, identically shaped, cutting blades 34, which are aligned in juxtaposed, spaced, parallel facing relationship to each other. Furthermore, each cutting blade 34 incorporates two arcuately curved cutting edges 37 and 38, which are positioned for contacting, reciprocating, cutting engagement with the inner surface of mesh screen or apertured foil 28.

In order to securely maintain each cutting blade 34 in the desired, aligned, spaced relationship, cutting blades 34 are securely affixed to each other by a plurality of elongated holding rods 35. Each rod 35 extends through the entire blade assembly, securely affixing and maintaining each cutting blade 34 in the precisely desired, aligned relationship. Blade assembly 33 is completed by mounting holding plate 36 along the base of the plurality of cutting blades 34, with holding plate 36 incorporating a drive pin receiving cavity formed therein.

With the drive pin receiving cavity securely mounted to upstanding, elongated, drive pin 23 of housing 21, the rapid, side-to-side movement of drive pin 23 simultaneously drives blade assembly 33 to move in the identical, side-to-side, reciprocating manner. In addition, with mesh screen or apertured foil 28 intimately held in frictional, contacting engagement with cutting edges 37 and 3 of blade members 34, electric dry shaver 20 provides the desired cutting of the short hairs or whiskers.

As detailed above, the movement of prior art shavers over the skin surface of the user often causes the mesh screen or apertured foil and the blade assembly to separate, thereby preventing the cutting action from occurring. However, by employing the enhanced cutting system of the present invention, this separation is eliminated and continuous, intimate, contacting engagement of mesh screen or apertured foil 28 with blade assembly 33 is provided throughout the shaving process.

In order to attain the desired, continuous, intimate contacting engagement of mesh screen or apertured foil 28 with blade assembly 33, an elongated, screen/foil biasing rod 40 is mounted in open zone 27 of base 26. As best seen in FIGS. 2, and 4–6, elongated biasing rod 40 is preferably mounted directly between arcuately curved portions 44 and 45 of mesh screen or apertured foil 28.

In the preferred construction, rod 40 comprises opposed ends 41 and 42, which extend beyond the side edges of mesh screen or aperture foil 28. In addition, rod 40 is cooperatively associated with biasing means which continuously draw rod 40 in a direction towards mesh screen or apertured foil 28, thereby assuring that mesh screen or apertured foil 28 is continuously maintained in intimate, frictional, contacting engagement with blade assembly 33. Preferably, the biasing means employed comprise coil springs 46 and 47.

As best seen in FIG. 4, one end of coil spring 46 is securely affixed to end 41 of rod 40, while the opposed end thereof is secured to post 48. Similarly, one end of coil spring 47 is secured to terminating end 42 of rod 40, while the opposed end of spring 47 is secured to post 49. As depicted in the drawings, post 48 and 49 extend from the inside surface of base 26, to provide a secure, immovable support for coil springs 46 and 47.

In the preferred embodiment, coil springs 46 and 47 are securely mounted, as detailed above, under tension between rod 40 and posts 48 and 49. In this way, spring members 46 and 47 are continuously attempting to return to their fully coiled position, thereby continuously acting upon elongated rod 40, causing rod 40 to be maintained in secure, intimate, contacting engagement with the outside surface of mesh screen or apertured foil 28. As a result of this construction, mesh screen or apertured foil 28 is maintained in secure, frictional, engagement with cutting edges 37 and 38 of blade assembly 33.

By employing this construction, any movement of mesh screen or apertured foil 28 is immediately counteracted by the downward spring biasing forces acting upon screen or foil 28 by biasing rod 40. In addition, any movement of blade assembly 33 away from the inside surface of screen or foil 28 is also immediately counteracted by the downward biasing force of rod 40 acting upon screen or foil 28, causing screen or foil 28 to be moved into contacting engagement with blade assembly 33. Consequently, separation of mesh screen or apertured foil 28 from cutting blades 34 of blade assembly 33 is prevented and screen or foil 28 is continuously maintained by rod 40 in secure, intimate, contacting engagement with cutting edges 37 and 38 of cutting blades 34.

Blade assembly 33 is mounted to drive pin 23 of housing 21 with the bottom surface of holding plate 36 maintained in juxtaposed, spaced relationship to platform 25. In addition, a plurality of bearing balls 55 are preferably mounted in contact with the lower surface of holding plate 36 and platform 25, in order to assure that the side-to-side, reciprocating movement of blade assembly 33 is smooth and trouble free. If desired, bearing balls 55 are individually retained in a channel formed in the base of holding plate 36, in order to enhance the smooth side-to-side motion.

In a further alternate embodiment, the surface of platform 25 incorporates a layer of soft, pliable or resilient material in order to enable bearing balls 55 to have a further degree of flexibility about the central axis of drive pin 23. In this way, additional vertical movement of blade assembly 33 is provided while biasing rod 40 assures that mesh screen or apertured foil 28 is maintained in secure, intimate, frictional, contacting engagement with blade assembly 33.

Although the use of bearing balls 55 is preferred, it has been found that the bearing balls can be eliminated without substantially affecting the efficacy of the present invention. Consequently, if desired, blade assembly 33 can be maintained in juxtaposed, spaced, facing relationship to platform 25, with drive pin 23 providing the desired side-to-side, reciprocating movement of blade assembly 33. In addition, due to the present invention, any movement of blade assembly 33 about the axis of drive pin 23 will be compensated by the biasing forces acting upon rod 40, thereby assuring that mesh screen or apertured foil 28 is maintained in continuous, contacting, frictional engagement with blade assembly 33, regardless of the movement thereof.

If desired, blade assembly 33 can be spring biased into contacting engagement with mesh screen or apertured foil 28 in the manner typically found in prior art shaver constructions. This biasing construction is achieved by mounting a coil spring about drive pin 23 which acts upon base 36 of blade assembly 33, causing blade assembly 33 to be urged upwardly towards mesh screen or apertured foil 28. If this construction were employed, the incorporation of elongated biasing rod 40 of the present invention would further complement the forces acting upon blade assembly 33, providing an additional biasing engagement force to maintain mesh screen or apertured foil 28 in continuous, following, contacting engagement with cutting edges 37 and 38 of blades 34 of blade assembly 33.

In FIGS. 7–11, an alternate embodiment for shaver 20 is fully detailed, incorporating the present invention in use with a reel-type blade assembly 70. In this embodiment, electric dry shaver 20 comprises a housing 21, incorporating a raised platform 25, on which reel-type blade assembly 70 is supportingly maintained. In addition, housing 21 incorporates a motor 59, which, as is fully detailed below, drives reel-type blade assembly 70.

In addition to housing 21, electric dry shaver 20 of this embodiment also comprises a guard/cover assembly 22 which is removably secured to housing 21. Guard/cover assembly 22 incorporates a base 26, which is constructed for telescopic, overlying, locking, interengagement with platform 25 of housing 21. In addition, release button 24 is mounted to housing 21 and cooperatingly engages base 26, enabling base 26 to be removed from housing 21. In this way, access to reel-type blade assembly 70 is obtained and cleaning of the blades, along with the surrounding area, is easily achieved.

Base 26 of guard/cover 22 incorporates an open zone 27 formed in the top portion thereof. Zone 27 is dimensioned for receiving flexible mesh screen or apertured foil 60 in its desired, secured, arcuately displayed configuration. Open zone 27 in combination with flexible mesh screen or apertured foil 60 provides the skin contact area for shaver 20.

In this embodiment, mesh screen or apertured foil 60 comprises a similar overall construction to the mesh screen or apertured foil 28 detailed above. However, in this embodiment, mesh screen or apertured foil 60 is removably retained by base 26 with a single, arcuately curved outer surface 63 forming the desired skin contacting surface.

Mesh screen or apertured foil 60 incorporates opposed terminating ends 61 and 62, both of which are removably secured to base 26. When in its retained position, mesh screen or apertured foil 60 is maintained in open zone 27 of base 26, fully displaying the single, arcuately curved surface 63 thereof, providing the desired skin contacting/shaving surface.

In the preferred embodiment, terminating end 61 of mesh screen or apertured foil 60 is removably mounted to one side surface of base 26, in the precisely identical manner detailed above in reference to the securement of mesh screen or apertured foil 28. As detailed therein, clip means 31 are mounted along a side surface of base 26 and cooperatively engage with receiving recesses formed in terminating end 61 of mesh screen or apertured foil 60. In this way, terminating end 61 of mesh screen or apertured foil 60 is removably secured to base 26.

As clearly shown in FIGS. 10 and 11, terminating end 62 of mesh screen or apertured foil 60 is movably and biasingly mounted to the opposed side surface of base 26, instead of being non-movably mounted to base 26 as is terminating end 61. In the preferred embodiment, the biasing means employed to securely and biasingly mount terminating end 62 of mesh screen or apertured foil 60 to base 26 comprises coil springs 65 and 66.

In the preferred embodiment, terminating end 63 of mesh screen or apertured foil 60 incorporates at least two holes or receiving zones 69 positioned in spaced relationship adjacent opposed sides of screen or foil 60. One end of coil spring 65 is securely affixed to hole 69 of mesh screen or apertured foil 60, while one end of coil spring 66 is securely affixed in the second hole 69 formed along end 62 of mesh screen or apertured foil 60. As clearly depicted in FIGS. 10 and 11, the opposed end of coil spring 65 is securely mounted to post 67, while the opposed end of coil spring 66 is securely affixed to post 68. Posts 67 and 68 are mounted to an inside surface of base 26, extending therefrom to provide the desired, fixed mounting locations for coil springs 65 and 66.

In the preferred embodiment, coil springs 65 and 66 are mounted under tension, thereby continuously maintaining a pulling force on mesh screen or apertured foil 60. As is more fully detailed below, this constant, spring biasing force continuously maintains mesh screen or apertured foil 60 in secure, frictional contact with the cutting blades of reel-type blade assembly 70.

As best seen in FIGS. 10 and 11, blade assembly 70 comprises a plurality of separate cutting blades 71, each of which incorporate cutting edges 74. Cutting blades 7 are securely mounted at their opposed terminating ends to a substantially circular shaped support plate 72. As a result of this construction, blade assembly 70 comprises a substantially cylindrical shape, with cutting blades 71 being longitudinally arrayed in parallel relationship to each other and to the central axis of cylindrically shaped blade assembly 70.

Blade assembly 70 also incorporates axis defining pivot posts 73 extending outwardly from plates 72, along the central axis of cylindrically shaped blade assembly 70.

As depicted in FIG. 11, posts 73 are rotationally mounted in upstanding columns 76 which are securely affixed to platform 25. In this way, cylindrically shaped blade assembly 70 is capable of rotating about the axis defined by post 73, enabling the cutting edges 74 of cutting blade 71 to continuously rotate in a cylindrical path about the central axis of blade assembly 70.

In order to achieve the desired rapid rotation of blade assembly 70, motor 59 is connected to a drive wheel 78 by belt 79. Although any desired alternate construction can be employed to obtain the desired rapid rotation of cylindrical blade assembly 70, FIG. 11 depicts the simple and inexpensive preferred embodiments.

In this particular embodiment, the output shaft of motor 59 directly drives endless belt 79 to move continuously. Belt 79 is connected to drive wheel 78 which is affixed to post 73 and blade assembly 70. In this way, the rotation of motor 59 causes drive wheel 78 to rapidly rotate cylindrically shaped blade assembly 70 about its central axis. This rotational movement causes each of the cutting edges 74 of each cutting blade 71 to continuously and rapidly move in a cylindrical path.

As clearly shown in FIG. 10, in the fully assembled configuration, cutting edges 74 of cutting blades 71 are positioned in frictional contacting engagement with the inside surface of mesh screen or apertured foil 60, thereby enabling cutting edges 74 to cooperate with the apertures to attain the desired cutting of the hair or beard follicles. Furthermore, by employing the spring biased construction of the present invention, the inside surface of mesh screen or apertured foil 60 is continuously maintained in frictional contacting engagement with cutting edges 74 of cutting blades 71.

By employing this construction, any movement of either blade assembly 70 or mesh screen or apertured foil 60, which would otherwise cause the mesh screen or apertured foil 60 to separate from cutting blade assembly 70, is prevented. Mesh screen or apertured foil 60 is constantly biased into continuous, contacting, frictional, interengagement with cutting edges 74 regardless of their movement due to the biasing forces of coil springs 65 and 66. In this way, trouble-free, continuous, contacting, interconnected, cutting, interengagement between blade assembly 70 and mesh screen or apertured foil 60 is assured.

If desired, bearing means 81 may be mounted in column 76 to peripherally surround rotating posts 73. In this way, the rapid rotational movement of blade assembly 70 is assured. Furthermore, if desired, bearing means 81 can be constructed in conjunction with flexible members which would enable some degree of longitudinal movement of blade assembly 70 relative to housing 21. Preferably, a construction of this nature would be employed if some degree of longitudinal movement of blade assembly 70 is considered important in order to enable blade assembly 70 to move in its entirety both towards and away from housing 21.

If this construction is employed, it is apparent from the preceding detailed disclosure that movable, biased mesh screen or apertured foil 60 continues to be maintained in contacting frictional engagement with cutting edges 74 of blade 71 of blade assembly 70 regardless of the movement of blade assembly 70. In this way, the desired continuous, contacting interengagement between cutting blade 71 and mesh screen or apertured foil 60 is assured.

A further improvement provided in the present invention is depicted in FIG. 10, wherein a movable brush assembly 85 is provided. Brush assembly 85 incorporates a substantially L-shaped support member 86 having bristle means 87 mounted at one end thereof and an activation button 88 formed at the opposed end thereof. By employing brush assembly 85, bristle means 87 is easily moved into contact with blade assembly 70, enabling bristle means 87 to contact and clean cutting edges 74 of blades 71 whenever desired. In this way, the longevity and efficacy of blade assembly 70 is further enhanced.

Although this embodiment of the present invention has been depicted in FIGS. 7–11 in use with a reel-type blade assembly, the use of mesh screen or apertured foil 60, with its single arcuately curved surface and its spring biased constructed, is equally applicable to any blade assembly configuration wherein a single arcuately curved surface is employed. Such blade assemblies include blade assemblies constructed in the manner detailed above in reference to FIGS. 1–6 wherein a single arcuately curved cutting edge is employed as opposed to the dual arcuately curved cutting edges depicted. In addition, various other blade configurations, well known in the art, can also be used in combination with the present invention with equal efficacy, without departing from the scope of this invention.

It will thus be seen that the objects set forth above, among those made apparent from the preceding description, are efficiently attained and, since certain changes may be made in the above constructions, without departing from the scope of the invention, it is is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim is new and desire to secure by Letters Patent is:

1. An electric dry shaver comprising:

A. a housing;

B. a blade assembly a. mounted in the housing for reciprocating movement relative thereto; and b. comprising a plurality of separate and independent cutting blades, each of said blades 1. being supportingly retained in juxtaposed spaced parallel relationship to each other, and 2. incorporating a substantially M-shaped cutting edge, C. an apertured foil member a. mounted to the housing, and b. cooperatingly associated with the blade assembly with a first surface of the foil member being in contacting engagement with the M-shaped cutting edges of the plurality of cutting blades forming the blade assembly, and a second surface thereof forming an elongated dual curved cutting zone; and D. biasing means cooperatively associated with the foil member for maintaining the blade assembly contacting surface in substantially continuous contacting engagement with the M-shaped cutting edges of the blade assembly, said biasing means comprising a. an elongated rod 1. mounted in longitudinally extending contacting engagement with the second surface of the foil member, and 2. positioned between the dual curved cutting zone of the foil member, and b. spring means controllably mounted to the elongated rod for continuously biasing the rod into engagement with the foil member, thereby causing said foil member to be continuously maintained in contact with the blade assembly.

2. The electric dry shaver defined in claim 1, wherein said blade assembly is further defined as comprising a plurality of bearing means positioned between the blade assembly and the housing to assure a smooth, continuous, trouble-free reciprocal movement of the blade assembly relative to the housing.

3. The electric dry shaver defined in claim 1, wherein said biasing means is further defined as comprising a pair of coil spring members, each of which is mounted under tension between one end of the elongated rod and the housing, thereby establishing a continuous biasing force on the foil member which maintains the foil member in frictional contacting engagement with the blade assembly.

4. The electric dry shaver defined in claim 3, wherein said housing is further defined as comprising a cover assembly a. removably mounted to the housing base for providing access to the blade assembly, b. having the foil member removably mounted thereto, and c. incorporating a pair of support posts affixed to a surface thereof and positioned for receiving and securely maintaining one end of the coil spring members, thereby assuring said spring members remain under tension.

* * * * *